US005950321A

United States Patent [19]

Peña et al.

[11] Patent Number: 5,950,321

[45] Date of Patent: Sep. 14, 1999

[54] ADHESIVE TAPE MEASUREMENT FOR LAP-SIDING BUILDING CONSTRUCTION

[76] Inventors: Ramon Peña, 4620 W. Cedar, Denver, Colo. 80219; Jesus A. Peña, 710 W. Berry Ave. Apt. 1, Littleton, Colo. 80120

[21] Appl. No.: 08/942,142

[22] Filed: Sep. 29, 1997

Related U.S. Application Data

[63] Continuation of application No. 08/656,660, May 31, 1996, abandoned.

[51] Int. Cl.[6] ..... G01B 3/10; G01D 21/00

[52] U.S. Cl. ..... 33/758; 33/759; 33/646

[58] Field of Search ..... 33/758, 759, 646, 33/648, 492

[56] References Cited

U.S. PATENT DOCUMENTS

| | | | |
|---|---|---|---|
| 1,170,521 | 2/1916 | Faison | 33/648 |
| 2,187,087 | 1/1940 | Leary | 33/758 |
| 2,932,897 | 4/1960 | Huber | 33/758 |
| 4,149,320 | 4/1979 | Troyer et al. . | |
| 4,217,379 | 8/1980 | Salavador . | |
| 4,367,590 | 1/1983 | Winter et al. . | |
| 4,845,858 | 7/1989 | Thomas | 33/759 |
| 4,879,818 | 11/1989 | Beaulieu | 33/646 |
| 4,899,459 | 2/1990 | Taggart | 33/646 |
| 4,942,670 | 7/1990 | Brandt | 33/759 |
| 5,012,590 | 5/1991 | Wagner et al. | 33/759 |
| 5,038,492 | 8/1991 | Bryant et al. | 33/758 |
| 5,056,234 | 10/1991 | Han | 33/759 |
| 5,404,651 | 4/1995 | Brodrick | 33/759 |

*Primary Examiner*—Christopher W. Fulton

*Attorney, Agent, or Firm*—Duft, Graziano & Forest, P.C.; Dan Cleveland, Jr.

[57] ABSTRACT

An adhesive tape (20) includes a plurality of marks (30–36) that facilitate the installation of lap-siding members (120, 122, 128, 132, 134) on a building (100). The tape is adhered to a wall (104, 106) in a vertical orientation, and the lap siding members are nailed in place over the tape. The marks function as guides for the positioning of the lap-siding members. The tapes is essentially free of indicia that can be confused with the marks to generate measurement errors in during the installation process.

10 Claims, 3 Drawing Sheets

ADHESIVE TAPE MEASUREMENT FOR LAP-SIDING BUILDING CONSTRUCTION

This application is a file wrapper continuation of application Ser. No. 08/656,660, filed May 31, 1996 now abandoned.

BACKGROUND OF THE INVENTION

1. Field of the Invention

The present invention pertains to the field of length measurement devices for use in building construction. More specifically, the method and apparatus of the present invention utilize an adhesive tape to facilitate the installation of lap-siding.

2. Statement of the Problem

Lap-siding consists of elongated boards or synthetic materials that substitute for boards. These materials are nailed to the outer frame of a house or other building under construction to provide an exterior siding that is pleasing to the eye. The name lap-siding refers to an overlapped sequence of boards that keeps water out, retains warm air in the building, and permits interior wall space to breathe for the effusion of trapped condensation or moisture. The boards are each positioned with their axis of elongation in a horizontal orientation, and nailed in place one above another with successively upward boards having their respective bottom portions overlapping a corresponding upper portion of the board beneath.

Commercial installation of lap-siding is performed by specialized work crews that reduce construction costs and the time spent in construction. A lap-siding installation crew typically works for a day or two to install the siding. By comparison, the same number of less experienced or less specialized workers might take a week or more, and the quality of the work performed by less experienced workers is often poor in comparison to that of the specialized crew. Once the siding has been installed, other specialized crews, e.g., painters and electricians, move in to perform tasks that can only be performed after the siding has been installed. If the siding installation requires an inordinate amount of time, these other crews can be kept waiting or requested to return another day. The delay can have a snowballing effect if the subsequent crews are not available at the preferred later time. These delays are particularly vexatious and costly to the general contractor. Thus, the use of professional lap-siding installation crews avoids or minimizes many problems.

The crews normally install lap-siding as described in this paragraph. The house is framed, and a vapor barrier (e.g., plastic or tar-paper) is placed on the outer portion of the frame. A horizontal datum line is drawn on the vapor barrier circumscribing the building around the lowermost portion of the fame proximal to the foundation. The horizontal datum line is drawn using a bubble-level device, and is placed a fixed distance above the foundation. This fixed distance is often selected to permit the bottommost siding board to overlap with the top of the foundation, or the bottom board may abut the foundation where overlap is not possible. At the corners of the building, a series fixed intervals are marked off above the datum line. If the span of a particular wall is very large, these markings may also be made on the middle portion of the wall. Two workers hold a lap-siding member in a position of alignment between two corresponding marks on opposite ends of a wall. The lap-siding member is nailed into place in this position. The next lap-siding member is installed in like manner, and the process continues until the vapor barrier is covered with siding. The process is repeated for other building walls. The lap-siding members generally have about one-half inch to one of overlap, i.e., they are about one-half inch to one inch longer than the fixed intervals that are marked above the datum line.

The most problematic aspect of the above-described installation process is that of measuring the fixed intervals above the datum line. Lap-siding typically surrounds the building to which it is attached. Thus, it is essential for the lap-siding members to join at common lines on the corners of the building; otherwise, the mismatched lines are an eyesore that indicates shoddy construction. Even where corner pieces are installed to hide the corners, mismatched lines of one-quarter to one-half inch or more are visible to the naked eye. Furthermore, the boards on a given wall run parallel to one another and, consequently, cannot be tipped at their ends to meet with boards on another wall without ruining this parallel relationship. The defect is immediately visible to the naked eye where boards do not run parallel with the other boards.

Even on professional installation crews, costly errors can result when the workmen who conduct these measurements sometimes to pay attention to detail. In other instances, measurement errors derive from an inexperienced crewmen or language difficulties. The errors are hopefully detected in time to avoid having to remove siding that has already been installed. The crew foreman is constantly having to check the work in progress, in order to ascertain whether a measurement error has been made. If it were not for having to guard against measurement errors, more crews could be allocated to a single foreman or manager.

Adhesive measurement tapes have been developed for use in some areas of building construction, but these are not suitable for use in lap-siding applications. For example, a patent to Thomas, U.S. Pat. No. 4,845,858, features a multicolored stud layout tape that is used to facilitate a framer's placement of studs. A single tape contains a plurality of multi-colored markings. Each different color of marking indicates a corresponding 16", 24", or 48" center. Thus, the tape can be affixed to a baseboard, and studs can be placed on a 16" fixed interval by aligning the butt of each stud with a color representative of a 16" interval. This tape cannot be used in lap-siding applications because the intervals do not correspond to lap-siding intervals. Additionally, the presence of multiple colors leads to confusion because the workmen can forget which color corresponds to what interval.

Wagner et al, U.S. Pat. No 5,012,590, features an adhesive measurement tape that is used to locate studs, joists, and rafters. The tape bears printed indicia, e.g., feet, circles, and diamonds, which mark fixed intervals corresponding to stud locations. Again, the tape enhances the possibility of errors that derive from confusion as to what mark corresponds to which interval, and the intervals do not correspond to lap-siding intervals.

There remains a true need to develop an adhesive measurement tape that can be used for the installation of lap-siding.

SOLUTION

The present invention overcomes the problems that are outlined above, and advances the a by providing a specialized adhesive measurement tape that facilitates the installation of lap-siding. Use of the tape is simplified because the tape contains few markings other than those that are essential for use in lap-siding installation. Thus, fewer errors result from the use of the tape.

The present invention involves an adhesive tape for use in reducing measurement errors during the installation of lap-siding. The adhesive tape is an elongated strip of flexible material including a flat first face and a flat second face. An adhesive coating resides on the first face, and the tape may be rolled, e.g., as in a roll of masking tape. The second face bears printed indicia that is used to align lap-siding members. The printed indicia consists essentially of a plurality of markings spaced apart at equal intervals corresponding to points of alignment for lap-siding members to be installed over the adhesive tape.

In preferred embodiments, the printed indicia have special forms that facilitate their use as guides in lap-siding installation. The markings preferably consist of a line drawn completely across the tape in a perpendicular orientation with respect to the axis of elongation in the tape. The markings also preferably include numerals positioned immediately adjacent each line. The numerals identify a distance corresponding to one of the equal intervals for lap-siding application. The markings also preferably include an ornamental design that is removed from the functional features of the markings by at least two inches so as not to cause confusion as to whether the ornamental design has functional features.

The markings on different tapes are preferably made of different colors that indicate specialized tapes for lap-siding intervals, i.e., the spacing for lap-siding members. For example, a black tape preferably indicates an eight inch interval, and a red tap indicates a six-inch interval. In this manner a tape having a specified color is selected from a multicolored set of tapes. A supervisor or crew foreman can view the installation procedure from a distance to ascertain that the installation in progress is proceeding according to the correct interval by virtue of the color of the tape that is utilized.

Other salient features, objects, and advantages will be apparent to those skilled in the art upon a reading of the discussion below in combination with the accompanying drawings.

DETAILED DESCRIPTION OF THE PREFERRED EMBODIMENT

Figure 1:
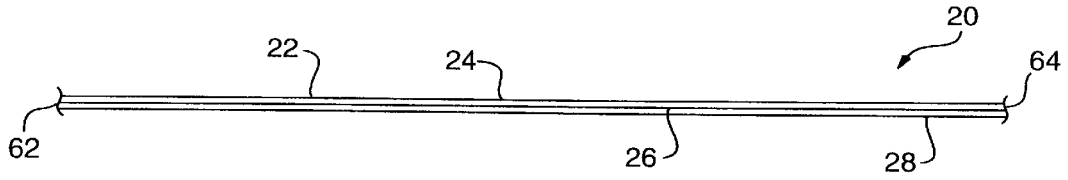
FIG. 1 depicts a side elevational view of an adhesive measuring tape according to the present invention.

FIG. 1 depicts a side elevational view of an elongated strip of masking tape 20 including a strip of paper 22 having a flat first face 24 and a flat second face 26. Face 26 is covered with a conventional masking tape adhesive 28.

Figure 2:
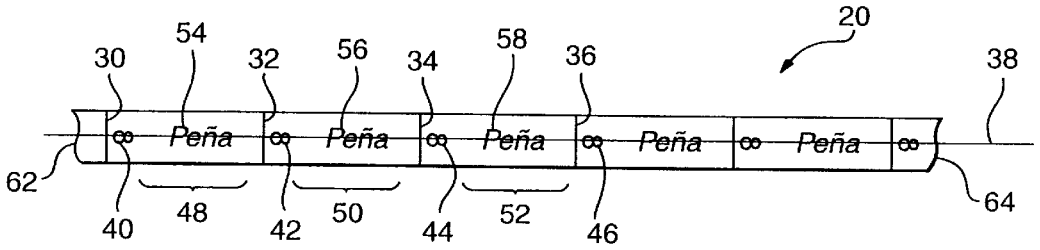
FIG. 2 depicts a top plan view of the adhesive measuring tape.

FIG. 2 depicts a top plan view of tape 20 that reveals additional details with respect to face 24. Face 24 bears a repeat pattern of printed indicia including a plurality of marks, e.g., marks 30, 32, 34, and 36 having a parallel orientation with respect to the axis of elongation 38 in tape 20. As a preferred feature of the invention, the indicia also include a corresponding plurality of numerals, e.g., numerals 40, 42, 44, and 46 that identify the distance or repeat intervals 48, 50, and 52 between adjacent marks. For example the numeral 40 or "8" immediately adjacent mark 30 indicates that there are eight inches in the interval 48 between mark 30 and mark 32. Similarly, the numeral 32 or "8" immediately adjacent mark 32 indicates that there are eight inches in the interval 50 between mark 32 and mark 34. The numerals 40–46 are preferably oriented for normal viewing when axis 38 is in a vertical orientation, i.e., they rise from their corresponding marks 30–36. The marks 30–36 are used as guides in the installation of lap-siding. The numerals 40–46 indicate to the workmen using tape 20 that an eight inch interval exists between the various markings 30–36.

Aside from the functional features of the indicia described above, the indicia also preferably includes a plurality of ornamental designs, e.g., designs 54, 56, and 58. As depicted, the design is a logo written in stylized form to identify "Peña" as the source of the tape. As indicated above, the ornamental designs are not essential to the functionality of tape 20, and may be omitted. Where the ornamental designs 54–58 are used, it is very much preferred to place them in positrons that are at least two inches removed from the markings 30–36 and the numerals 40–46, e.g, the distance between the "a" in "Peña" and mark 32 preferably exceeds two inches. This placement of the ornamental design assures that the design will not be confused with functional features 30–36 and 40–46 of the indicia and, consequently, substantially no measurement errors derive from confusion of the design features. It is an especially preferred feature of the invention that the elements 30–36, 40–46, and 54–58 constitute the only elements of the indicia on face 24 of tape 20. Thus, the simple design of tape 20 facilitates lap-siding installation with fewer measurement errors because the markings 30–36 are readily available to guide the installation of lap-siding members.

Figure 3:
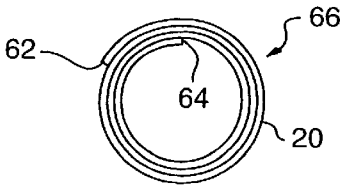
FIG. 3 depicts the adhesive measuring tape rolled in a preferred for storage.

Tape 20 has two ends 62 and 64. As depicted in FIG. 3, it is a preferred feature of the invention that tape 20 is supplied in a roll 66 wound with end 64 in a radially inboard position with respect to end 62. Thus, when tape 20 is unwound in an upward or increasingly vertical direction from end 62 to end 64, numerals 40–46 appear as normal print.

It is to be understood that the features of tape 20 as depicted in FIGS. 1–3 are intended to express preferred features of the invention, and may be adapted for use in other lap-siding installations that do not correspond to eight inch intervals. For example, the intervals 48–52 and numerals 40–46 can represent five, six, seven, 8.5, or nine inch intervals. For example, where the interval is a five inch interval, the numeral "5" replaces the numeral "8" for each of numerals 40–46, and the intervals 48–52 all have five inch lengths. A preferred feature of the invention recognizes that lap-siding members have different sizes, and assures that workmen will be less likely to use a tape having the wrong interval, by implementing a system wherein each tape is assigned a specific color that is unique to a given interval. For example, indicia on the five inch interval tape is blue, indicia on the seven inch interval tape is red, and indicia on the eight inch interval tape is black. Thus, the error will be immediately apparent to a crew foreman who observes a red-printed tape in place on a building where eight inch lap-siding members are to be installed. The lap-siding members that are to be installed over tape 20 have lengths that typically exceed the marked interval on the tape by about one inch to permit the respective lap-siding members to overlap when they are installed. The exact length of overlap may vary according to regional construction practices and materials.

The materials that are used for tape 20 preferably include masking tape because of its relatively low expense and the variety of commercial manufacturers who have equipment that can print on this medium. Alternatively, tape 20 can be made of any suitable material, such as vinyl, Mylar, or aluminum, that will receive and hold printed indicia.

Lap-siding Installation

Figure 4:
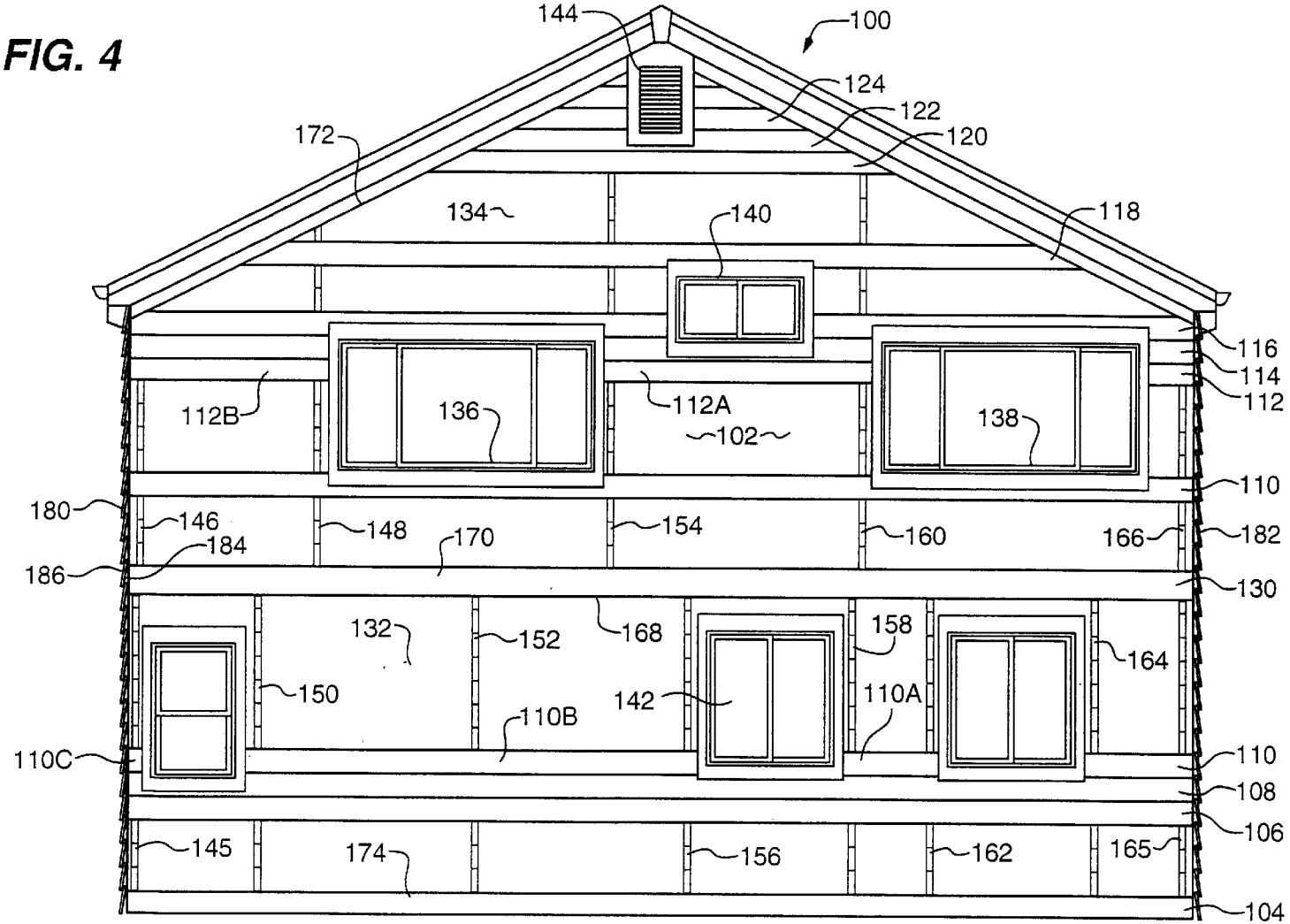
FIG. 4 depicts a partially constructed house with construction in progress using the measuring tape of FIG. 1.

FIG. 4 depicts a partially constructed house 100 having an exterior tar-paper covered wall 102 that is in the process of being covered with a plurality of lap-siding members, e.g., members 104, 106, 108, 110, 112, 114, 116, 118, 120, and 122, 124. An outer Balley band 130 circumscribes house 100 at the junction between first floor 132 and second floor 134. Wall 102 contains a plurality of windows, e.g., windows 136, 138, 140, and 142; as well as attic vent opening 144. FIG. 4 depicts portions of tape 20 (see FIG. 1) as respective vertically oriented strips 145, 146, 148, 150, 152, 154, 156, 158, 160, 162, 164, 165, and 166. Strips 145, 150, 152, 156, 158, 162, 164, and 165 rise from bottom siding member 104 to the bottom 168 of Balley band 130. Similarly, strips 146, 148, 154, 160, and 166 rise from the top 170 of Balley band 130 to soffit 172.

A pencil and a bubble leveling device are used to draw a datum line corresponding to the top 174 of bottom lap-siding member 104. A construction worker draws this line completely around the outer circumference of house 100. Tape strips 145, 150, 152, 156, 158, 162, 164, and 165 are positioned with a selected mark (e.g., mark 30 of FIG. 2) aligned with the top 174 of bottom siding member 104, and unrolled from rolled 66 (see FIG. 3) upwardly towards Balley band 130. Similarly, strips 146, 148, 154, 160, and 166 are aligned with the top 170 of Balley band 130, and are unrolled from roll 66 towards soffit 172. Thus, all of the strips on lower story 132 are aligned at a common interval of measurement, as are the strips on upper story 134. For example, lap siding member 110 is subdivided into three parts of equal elevation, i.e., parts 110*a*, 110*b*, and 110*c*. Lap siding member 112 is subdivided into portions 112*a* and 112*b*. These different portions are aligned at uniform elevations from the corresponding measurement base (e.g., bottom lap-siding member 104 in the case of lap siding member 110) by aligning the top of the respective boards even with elevationally aligned marks on strips 145–165. Thus, the ends of parts 110*a* and 110*b* proximal to window 142 are aligned at equal elevations, as are the ends of the portions of lap-siding member 112 that accommodate windows 136 and 138.

Other walls of house 100 intersect wall 102 to form corners 180 and 182. These other walls are provided with tape strips similar to strips 145–165 in a manner similar to the manner depicted for wall 102, i.e., with one tape strip proximal to each corner and additional tape strips as needed to bracket windows (e.g., strips 156 and 158) and others (e.g., strip 152) for use in the alignment of lap-siding members having a span less than the span of wall 102 across their axis of elongation. The tapes installed on these other walls are aligned with their corresponding common datum line corresponding to the top 174 of bottom lap-siding member 104 or Balley band 130, in order to place the distal ends of lap-siding members on these other walls in substantial alignment with the corresponding distal ends of lap-siding members on wall 102, e.g., as end 184 is in exact elevational alignment with end 186 of a corresponding lap-siding member on a wall having an orthogonal relationship to wall 102.

Figure 5:
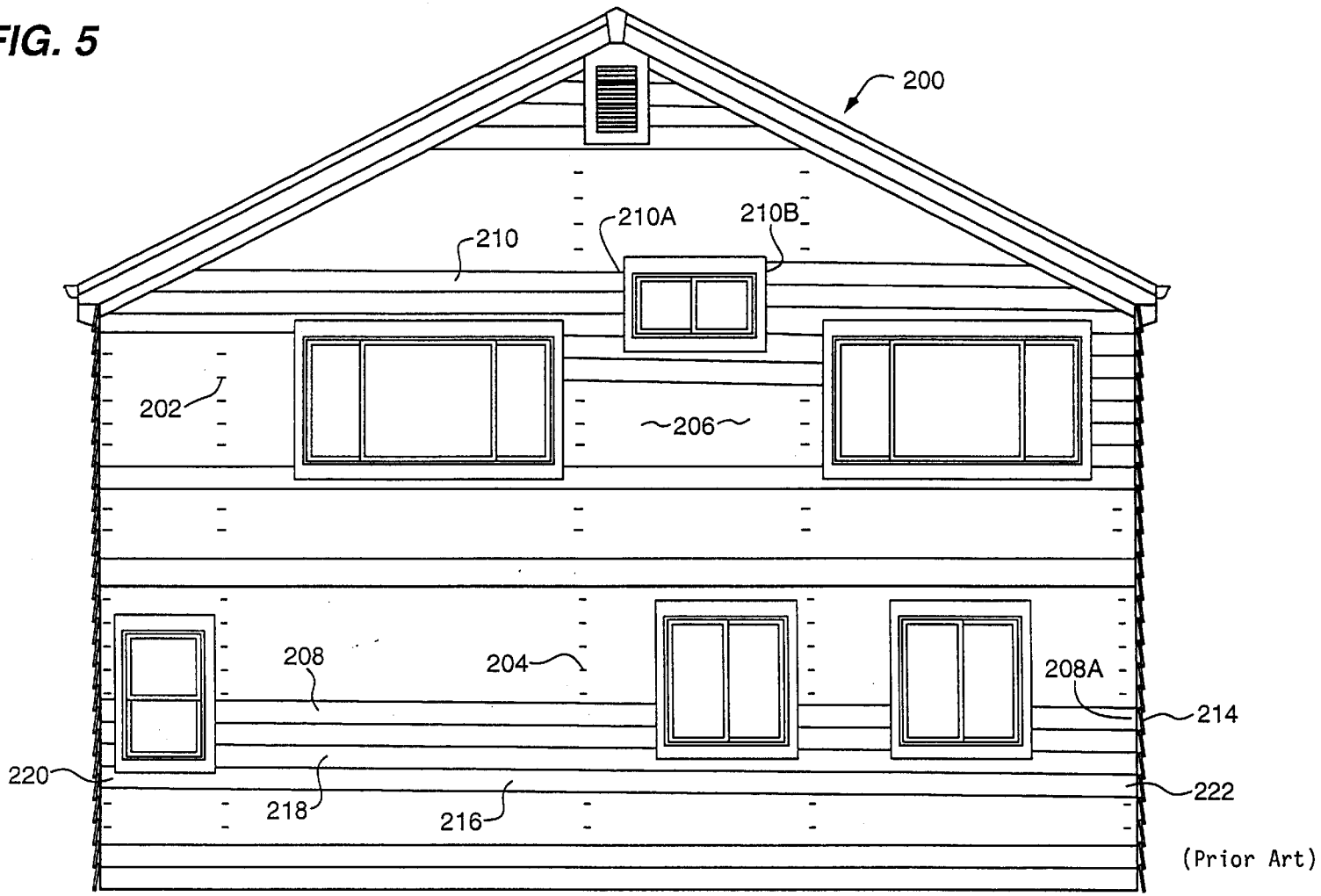
FIG. 5 depicts a partially constructed house with construction in progress without using the measuring tape of FIG. 1.

FIG. 5 depicts the numerous problems that arise in the prior art when attempting to install lap-siding on a house 200 that is similar to house 100. The construction crew has attempted to place hand markings, e.g., markings 202 end 204, on wall 206. These markings attempt to define the interval between respective lap-siding members, e.g., members 208 and 210. The installation of lap-siding on house 200 requires that hundreds of these markings must be made. Owing to inadvertent measurement errors there are substantial misalignments that require the lap-siding to be removed and replaced. For example, end 210*a* is more than two inches lower than end 210*b*. End 208*a* is more than one-half inch higher then orthogonally aligned end 214. Lap-siding member 216 is canted at a vertical angle with respect to member 218 and, consequently, end 220 has one inch less visible height than does and 222. Without tape 20, it is nearly impossible for a crew to apply measurements to house 200 for the installation of lap-siding without generating these types of alignment errors.

Those skilled in the art understand that the preferred embodiments, as described above, may be subjected to apparent modifications without departing from the true scope and spirit of the invention. The inventors, accordingly, hereby state their intention to rely upon the Doctrine of Equivalents, in order to protect their full rights in the invention.

We claim:

1. An adhesive tape for use in reducing measurement errors in the installation of lap-siding, consisting essentially of:

an elongated sheet of flexible material including a flat first face and a flat second face remote from said first face, said elongated sheet of flexible material presenting a longitudinal axis;

an adhesive coating on said first face;

printed indicia on said second face; and a single color indicia on said second face;

said printed indicia consisting essentially of markings spaced apart at a single interval corresponding to a vertical distance between lap-siding members to be installed over said elongated sheet, and numerals corresponding to said vertical distance placed adjacent said markings;

said elongated sheet having a rolled configuration placing said numerals in an orientation for normal viewing when said adhesive tape is unrolled vertically from a bottom of a building wall to a top of said building wall in a fixed vertical relationship to an elevational datum located along said bottom of said building wall.

2. The adhesive tape as set forth in claim 1 wherein said elongated sheet and said adhesive coating are a roll of masking tape.

3. The adhesive tape as set forth in claim 1 wherein said markings each consist of a line drawn completely across said second face in a perpendicular orientation with respect to said longitudinal axis of said adhesive tape.

4. The adhesive tape as set forth in claim 1 wherein said printed indicia additionally consists essentially of an ornamental design.

5. The adhesive tape as set forth in claim 1 wherein said color provides means for identifying said adhesive tape as a selected member from a set of a plurality of differently colored adhesive tapes with each different color representing a different interval between said markings.

6. A quick method of reducing measurement errors during the installation of lap-siding, said method comprising the steps of:

providing an adhesive tape including a longitudinal axis and a face bearing printed indicia thereon, wherein said printed indicia consists essentially of a plurality of markings spaced apart at a single interval corresponding to a vertical distance between lap-siding members to be installed over an elongated sheet, and numerals corresponding to said vertical distance placed adjacent said markings, said numerals having an orientation for normal viewing when said longitudinal axis is placed in a vertical orientation;

placing a common elevational datum line on a building wall;

adhering a first portion of said adhesive tape to said building wall in a fixed vertical relationship to said elevational datum line to position markings on said first portion of said adhesive tape at a plurality of first elevational datum points spaced apart from said elevational datum line at equal intervals;

affixing a second portion of said adhesive tape to said building wall in a fixed vertical relationship to said elevational datum line to position said markings on said second portion of said adhesive tape at a plurality of second elevational datum points that cooperate with said first plurality of datum points to define a plurality of lines in a substantially parallel orientation with respect to said elevational datum line, wherein each of said lines is defined by a first datum point selected from said first plurality of datum points and a second datum point selected from said second plurality of datum points;

aligning a lap-siding member edge with one of said lines to establish a position of alignment; and attaching said lap-siding member to said building wall in said position of alignment.

7. The method as set forth in claim 6 wherein said adhering step includes a step of offsetting a bottom one of said equal intervals from said elevational datum line a sufficient distance to permit overlap between subsequent lap siding members positioned in respective positions of alignment corresponding to said plurality of lines.

8. The method as set forth in claim 6 wherein said placing step includes a step of drawing said line around an outer circumference of a building.

9. The method as set forth in claim 6 wherein said aligning step includes a step of adjusting opposite ends of said lap siding member with respect to said first portion of adhesive tape and said second portion of adhesive tape.

10. The method as set forth in claim 6 wherein said providing step includes a step of selecting a tape having equally spaced intervals including one member selected from the group consisting of five inch intervals, six inch intervals, seven inch intervals, eight inch intervals, and eight and one-half inch intervals.

* * * * *